US006109315A

United States Patent [19]

Stern

[11] Patent Number: 6,109,315

[45] Date of Patent: Aug. 29, 2000

[54] DISPENSING DEVICE AND PACKAGE FROM WHICH A LIQUID PRODUCT PREFERABLY LIQUID FOODSTUFF SHALL BE DISPENSED BY MEANS OF THE DISPENSING DEVICE AS WELL AS A COUPLING DEVICE AT SAID PACKAGE

[75] Inventor: Leif Einar Stern, Lomma, Sweden

[73] Assignee: Asept International AB, Lund, Sweden

[21] Appl. No.: 09/161,100

[22] Filed: Sep. 25, 1998

[30] Foreign Application Priority Data

Sep. 29, 1997 [SE] Sweden ..... 9703496

[51] Int. Cl.[7] ..... B65B 1/04

[52] U.S. Cl. ..... 141/330; 141/114; 141/375; 222/81; 222/105; 604/403; 604/411

[58] Field of Search ..... 141/330, 329, 141/364, 375, 114, 351, 352, 353, 554; 222/105, 81, 83, 83.5, 88; 604/403, 408, 411, 412, 413, 414, 415

[56] References Cited

U.S. PATENT DOCUMENTS

| | | | |
|---|---|---|---|
| 2,732,017 | 12/1954 | Fleming . | |
| 3,081,911 | 3/1963 | Scholle | 222/107 |
| 3,884,387 | 5/1975 | Vannucci . | |
| 4,076,147 | 2/1978 | Schmit . | |
| 4,314,654 | 2/1982 | Gaubert . | |
| 4,337,769 | 7/1982 | Olson | 128/214 |
| 4,484,697 | 11/1984 | Fry | 222/95 |
| 4,562,940 | 1/1986 | Asphar | 222/88 |
| 4,603,793 | 8/1986 | Stern . | |
| 4,679,705 | 7/1987 | Hamilton . | |
| 5,042,690 | 8/1991 | O'Meara . | |
| 5,407,099 | 4/1995 | Heuke et al. . | |
| 5,551,606 | 9/1996 | Rai et al. | 222/460 |
| 5,730,327 | 3/1998 | Stern | 222/82 |

FOREIGN PATENT DOCUMENTS

| | | |
|---|---|---|
| 0162417 | 11/1985 | European Pat. Off. . |
| 0229493 | 7/1987 | European Pat. Off. . |
| 1104359 | 2/1968 | United Kingdom . |
| 81/01992 | 7/1981 | WIPO . |
| 9200895 | 1/1992 | WIPO . |

*Primary Examiner*—Henry J. Recla
*Assistant Examiner*—Huyen Le
*Attorney, Agent, or Firm*—Tarolli, Sundheim, Covell, Tummino & Szabo L.L.P.

[57] ABSTRACT

A dispensing device for dispensing portions of liquid products (5) from a package (1) with flexible walls (4) is provided. A package and a coupling device are provided. The package (1) comprises a first coupling device (6), a dispensing device (3), for dispensing portions of the liquid product (5) from the package (1), comprises a second coupling device (19) and a cassette (2), in which the package (1) can be located, comprises a third coupling device (20). The first coupling device (6) of the package (1) and the third coupling device (20) of the cassette (2) are interconnectable without opening the package (1) and, when said first and third coupling devices (6 and 20) are interconnected, the first coupling device (6) of the package (1) can be connected to the second coupling device (19) of the dispensing device (3) such that the package (1) is opened.

29 Claims, 6 Drawing Sheets

6
40
39
5
3
37a
K
37
25
36
4
35
23
24
38
A
B
34
19

DISPENSING DEVICE AND PACKAGE FROM WHICH A LIQUID PRODUCT PREFERABLY LIQUID FOODSTUFF SHALL BE DISPENSED BY MEANS OF THE DISPENSING DEVICE AS WELL AS A COUPLING DEVICE AT SAID PACKAGE

BACKGROUND OF THE INVENTION

The present invention relates to a dispensing device for dispensing portions of a liquid product, preferably liquid foodstuff, from packages having flexible walls, whereby the package comprises a first coupling device, whereby a dispensing device for dispensing portions of the liquid product from the package comprises a second coupling device and whereby the first coupling device of the package and the second coupling device of the dispensing device are interconnectable to open the package and permit dispensing of portions of the liquid product therefrom.

The invention also relates to a package from which a liquid product is to be dispensed by means of said dispensing device.

The invention further relates to a coupling device at said package.

From the publication EP 0 162 417 A2 it is already known a dispensing device consisting of a flexible package having a first coupling device, a cassette in which the package is located and having a second coupling device, as well as a dispensing device having a third coupling device. The coupling devices for the package and the cassette are interconnectable without opening the package and the coupling devices for the package and the dispensing device are interconnectable so that the product can be discharged from the package.

At this prior art dispensing device it is not possible to first locate the package in the cassette and then the cassette with the package therein at a place where the dispensing device is located, and in connection therewith see to that the coupling device of the dispensing device opens sealed portions of the package and is connected to a coupling device located inside the package.

The object of the present invention has been at first hand to eliminate these drawbacks. This is done according to the invention by providing the initially defined dispensing device with the characterizing features of subsequent claim 1.

Since the coupling device of the cassette has one or more support members for the inner coupling device of the package, said package, lying in the cassette, can easily be brought to the dispensing device and its inner coupling device can easily and safe be connected to the coupling device of the dispensing device.

BRIEF DESCRIPTION OF THE DRAWINGS

The invention will be further described below with reference to the accompanying drawings, in which FIG. 1 schematically illustrates how a package included in the dispensing device according to the invention is located in a cassette which in turn, with the package, is located at the dispensing device.

DETAILED DESCRIPTION OF THE INVENTION

Figure 1:
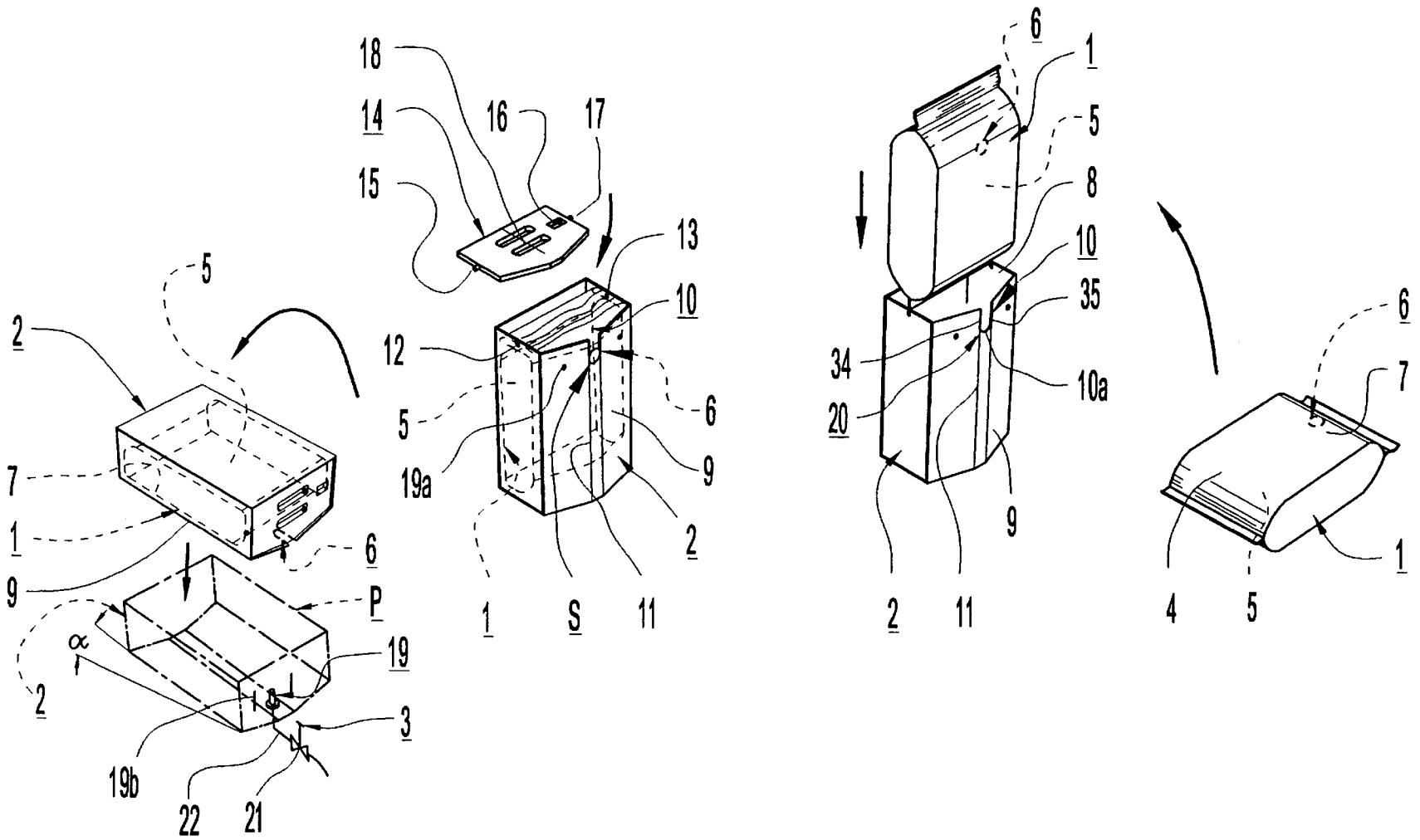
Figure 2:
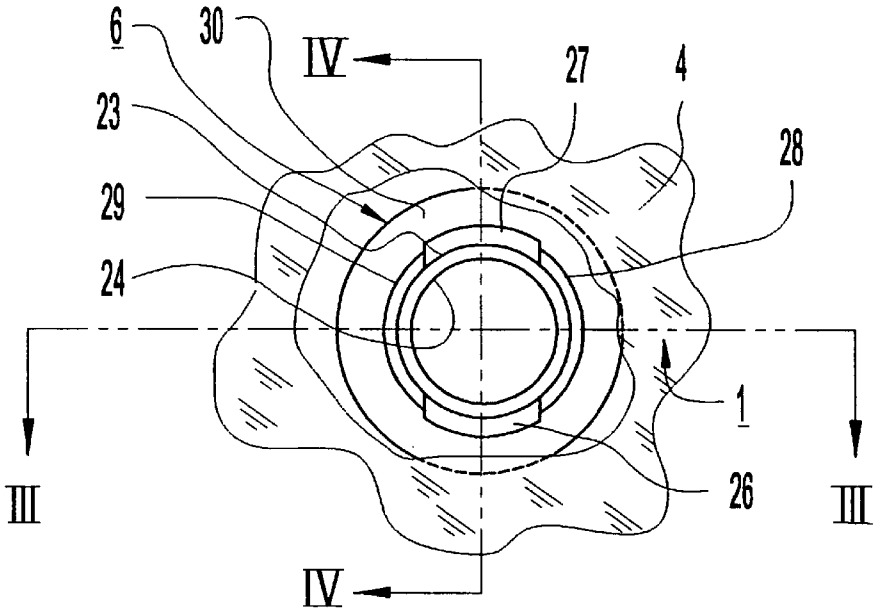
FIG. 2 in a larger scale illustrates a portion of the cassette of FIG. 1 with a coupling device included in the package.
Figure 3:
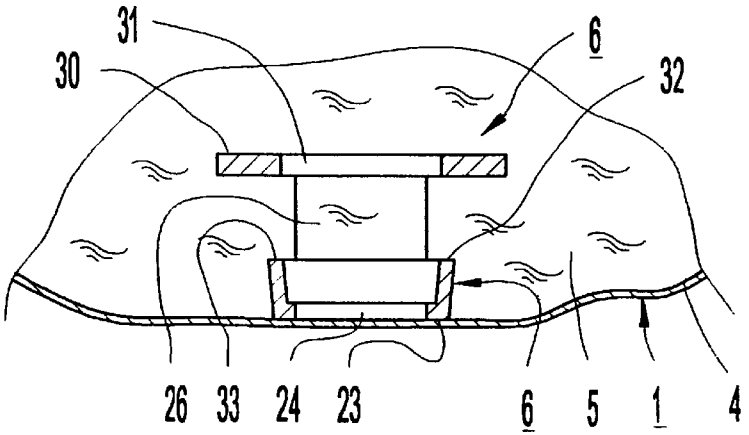
FIG. 3 is a section III—III of the package of FIG. 2 and of a coupling device included therein.
Figure 4:
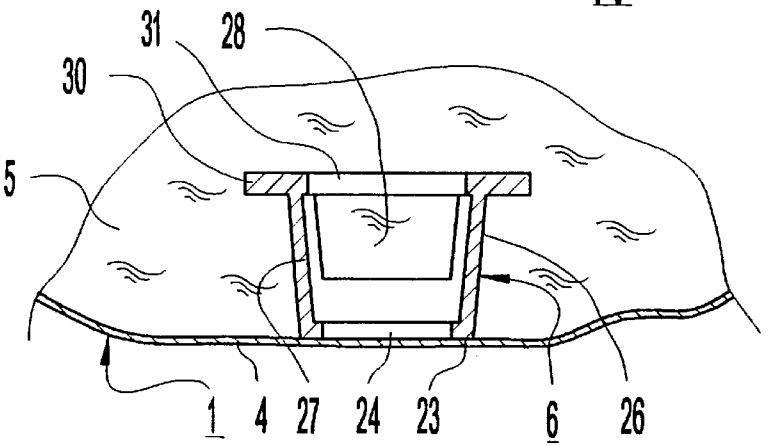
FIG. 4 is a section IV—IV of the package of FIG. 2 and of the coupling device included therein.
Figure 5:
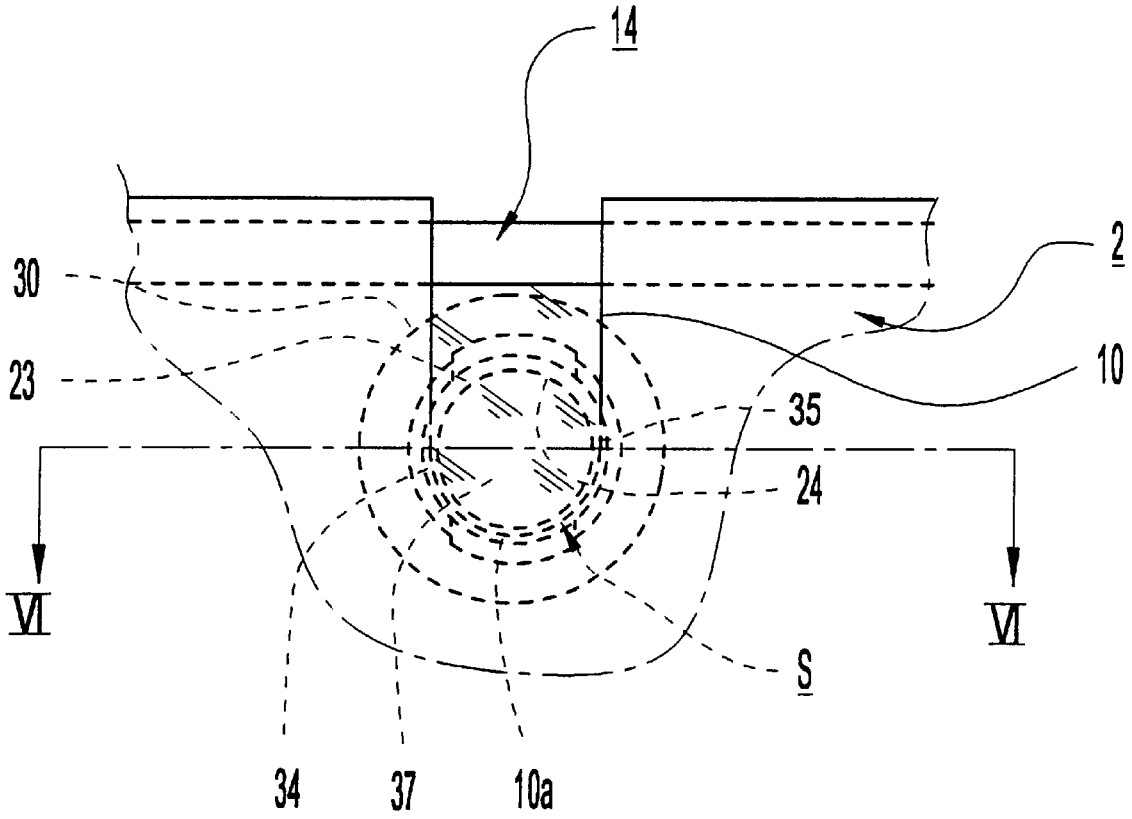
FIG. 5 illustrates a portion of the cassette of FIG. 1 with a package located therein.

The drawings illustrate a package 1, a cassette 2 and a schematically shown dispensing device 3. The package 1 has flexible walls 4 and contains a liquid product 5, preferably liquid foodstuff such as e.g. ketchup, mustard or similar. Inside the package 1 there is located a first coupling device 6 which is mounted on the inner side of a portion 7 of the flexible walls 4 and the dispensing device 3 has a second coupling device 19 and the cassette 2 a third coupling device 20. The cassette 2 has an opening 8 through which the package 1 can be located in said cassette. Approximately in the middle of an edge of one side 9 of the cassette 2, its third coupling device 20 has a recess 10 for the first coupling device 6 of the package 1 and said recess 10 is situated at the end of a chute 11 extending along said side 9 and defined by said side 9 being angled to some extent. The cassette 2 also has two holes 12, 13 which are adapted to hold or retain a cover 14. The cover 14 is adapted to close the opening 8 in the cassette 2 and includes a pin 15 which can be inserted into the hole 12 in the cassette 2 and a pin 17 which is loaded in outwards direction by a spring 16. The pin 17 can be depressed such that the cover 14 can be located in the cassette 2 and when the pin 17 is situated opposite the hole 13, the spring 16 will force said pin 17 into said hole 13, whereby the pins 15, 17 retain the cover 14 at the cassette 2. The cover 14 might also have a handle 18 which can be defined by two elongated holes in the cover 14 and in which the cover 14 with attached cassette 2 can be carried.

When the package 1 is located in the cassette 2 and its first coupling device 6 and the third coupling device 20 of the cassette are interconnected, the cassette 2 can be turned so that it lies down, in which position the cassette can be lowered to said dispensing device 3 into a position (indicated by dashed and dotted lines in FIG. 1), whereby the first coupling device 6 of the package 1 can be connected to the second coupling device 19 of the dispensing device 3.

On the cassette 2 and/or at the dispensing device 3 there may be provided guide means 19*a*, 19*b* for guiding the cassette 2 when it, with the first coupling device 6 of the package 1 and the third coupling device 20 of the cassette 2 interconnected, is located in a dispensing position P wherein the first coupling device 6 of the package 1 is connected to the second coupling device 19 of the dispensing device 3. Said guide means can be at least one hole 19*a* in the cassette 2 and at least one guide pin 19*b* on or at the dispensing device 3, whereby the guide pin 19*b* is adapted to engage the hole 19*a* for guiding the cassette 2 when it is brought to the dispensing position P.

The dispensing device 3 may include members which are angled relative to the horizontal plane (angle α in FIG. 1) such that the cassette 2 is held obliquely with its side 2 inclining downwards towards the second coupling device 19 of the dispensing device 3. Hereby, emptying of the package 1 is facilitated.

By connecting the first coupling device 6 of the package 1 and the second coupling device 19 of the dispensing device 3 to each other, the package 1 is opened and its liquid content 5 can be dispensed in portions by opening a valve 21 forming part of a dispensing pipe or a dispensing hose 22 in said dispensing device 3.

The first coupling device 6 of the package 1 comprises a female coupling member 23 which by heat treatment or in any other suitable way is attached to the inner side of portions 7 of the flexible walls 4 of the package 1. The female coupling member 23 can be annular in shape and defines an opening 24 for a male coupling member 25 on the second coupling device 19 of the dispensing device 3. On the female coupling member 23 there are provided two parts 26, 27 which are directed into the package 1. Between these parts 26, 27 there are provided openings 28, 29 and their inner end portions are connected to an inner, preferably annular part 30 with an opening 31. The purpose of this design of the female coupling member 23 is that the liquid product 5 shall flow through the openings 28, 29 and 31 when the package 1 is emptied while said parts 26, 27 and 30 shall prevent the flexible walls 4 of the package 1 from covering the opening in the male coupling member 25 through which said emptying is carried through, such that this opening is not obstructed.

The female coupling member 23 has opposed parts 32, 33 which protrude in opposite directions relative to the inwardly directed parts 26, 27. The cassette 2 comprises two support members 34 and 35 which can be defined by two edge portions on opposite sides of the recess 10. These edge portions 34, 35 are adapted to intervene within the opposed parts 32, 33 of the female coupling member 23 when the first coupling device 6 of the package 1 and the third coupling device 20 of the cassette 2 are interconnected. The flexible walls 4 of the package 1 have inwardly foldable portions 36 around the coupling device 6 for enabling said interconnection.

As is shown in FIG. 1, a cassette 2 is placed with the opening 8 upwards and the cover 14 is removed. Then, a sealed package 1 is located above the cassette 2 with its coupling device 6 at the top and the package 1 is held at the top such that the liquid product 5 therein expands or stretches its flexible walls 4. The package 1 is in this condition lowered down into the cassette 2 and when the package 1 is completely lowered, the portion 7 of the flexible walls 4 engages the side 9 of the cassette 2. Additionally, the other portions of the flexible walls 4 engage in expanded condition the other sides of the cassette 2.

Figure 6:
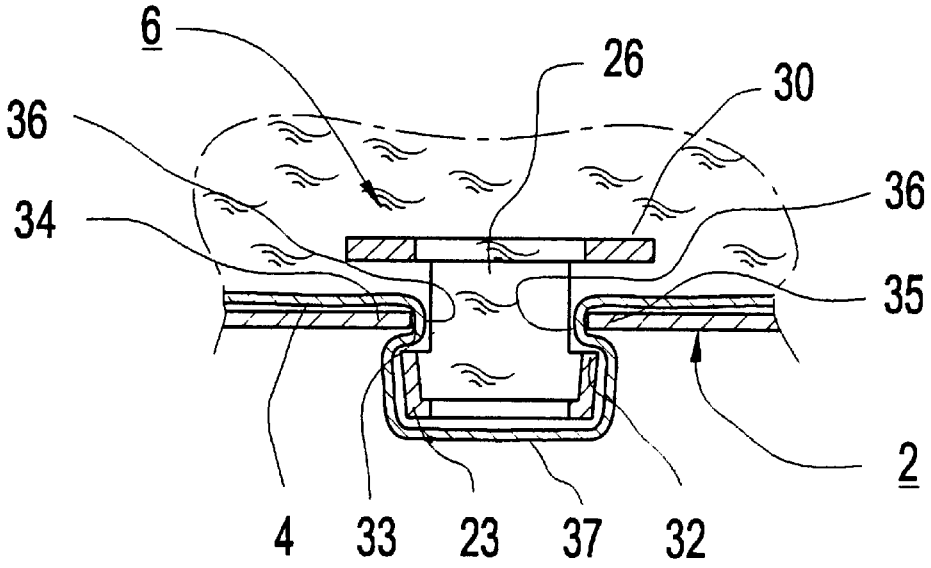
FIG. 6 is a section VI—VI of the cassette and the package of FIG. 5.

The first coupling device 6 is located in the package 1 such that during or after the lowering of the package 1 into the cassette 2 one can connect the package to the third coupling device 20 of the cassette 2 so that the first coupling device 6 gets a supporting position S in which it is supported by the cassette 2. This is accomplished by manually or eventually by means of the upper edges of the cassette 2 on both sides of the recess 10 folding or bending said inwardly foldable portions 36 of the flexible walls 4 on both sides of the first coupling device 6 of the package 1 inwards behind the opposed parts 32, 33 of the first coupling device 6, and locating the female coupling member 23 in the recess 10 such that its opposed parts 32, 33 will be situated in front of the support members 34 and 35 (see inter alia FIG. 6). The female coupling member 23 is inserted into the recess 10 until it engages the bottom 10*a* of said recess 10, whereupon eventual upper, unfilled or not completely filled portions of the package 1 are folded down into the cassette 2 so that the entire package 1 will be situated therein. Then, the cover 14 is placed on the cassette 2 and locked in a position in which it sees to that the first coupling device 6 is retained in its exact supporting position S at the bottom of the recess 10.

By this application of the first coupling device 6 to the cassette 2, the female coupling member 23 will be located outside the cassette 2 and its opposed parts 32, 33 will as mentioned be situated in front of the support members 34, 35 of the cassette 2 and between them the inwardly folded portions or parts 36 of the portion 7 of the flexible walls 4. Thus, the first coupling device 6 of the package 1 will be fixed to the third coupling device 20 of the cassette 2 in a supporting position S in which it, through inwardly folded or bent portions 36 of the flexible walls 4 of the package 1, is supported by the cassette 2 at the subsequent coupling moment when the first coupling device 6 of the package 1 is connected to the second coupling device 19 of the dispensing device 3.

When the package 1 is located in the cassette 2 and the cassette 2 is closed by means of the cover 14, the cassette 2 is turned such that the side 9 thereof will form its underside. In this position, the cassette 2 is lowered towards the guide pins 19*b* so that said pins engage the holes 19*a* in the cassette 2. Hereby, the first coupling device 6 of the package 1 reaches a predetermined position relative to the second coupling device 19 of the dispensing device 3.

Figures 7, 8, 9:
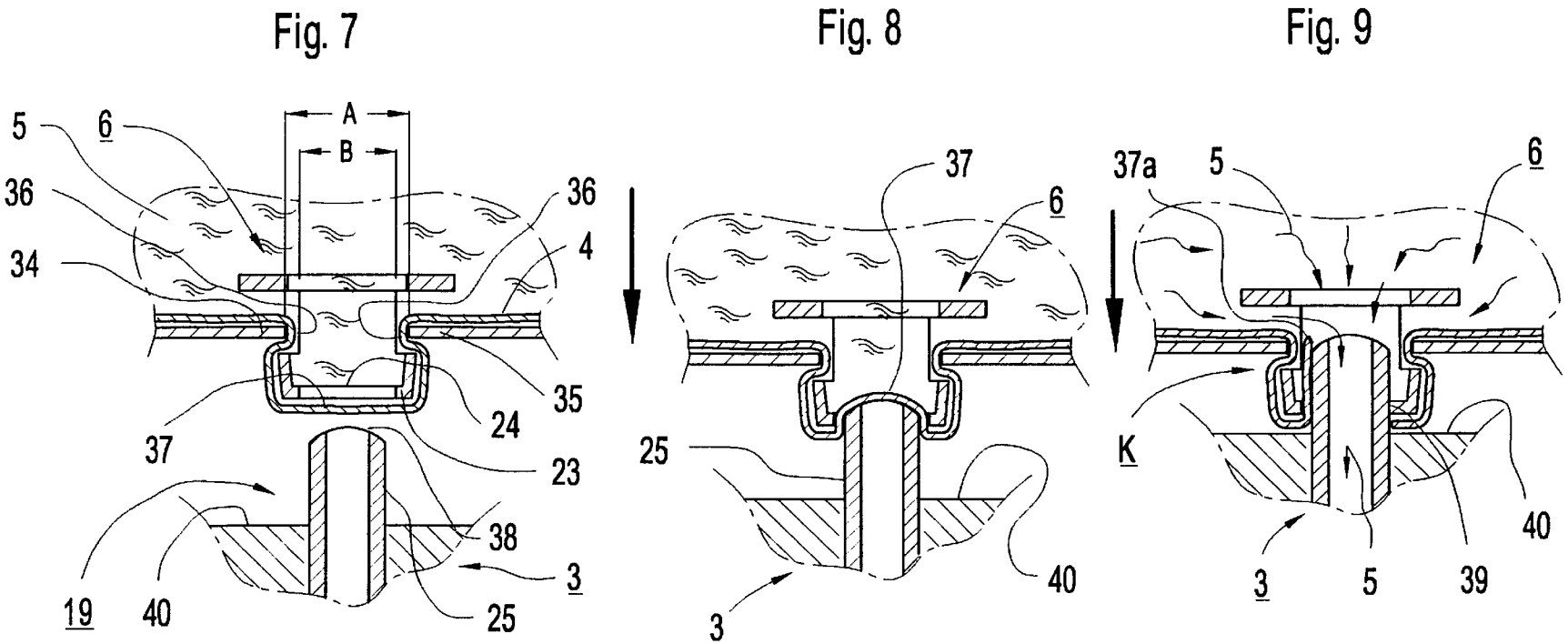
FIG. 7 is a section of a portion of the cassette, the package and its coupling device and of a portion of a coupling device included in or forming part of the dispensing device before interconnection of the coupling devices.
FIG. 8 is a section corresponding to FIG. 7 during interconnection of the coupling devices.
FIG. 9 is a section corresponding to FIG. 7 and 8 after interconnection of the coupling devices and with the package unopened.
Figure 10:
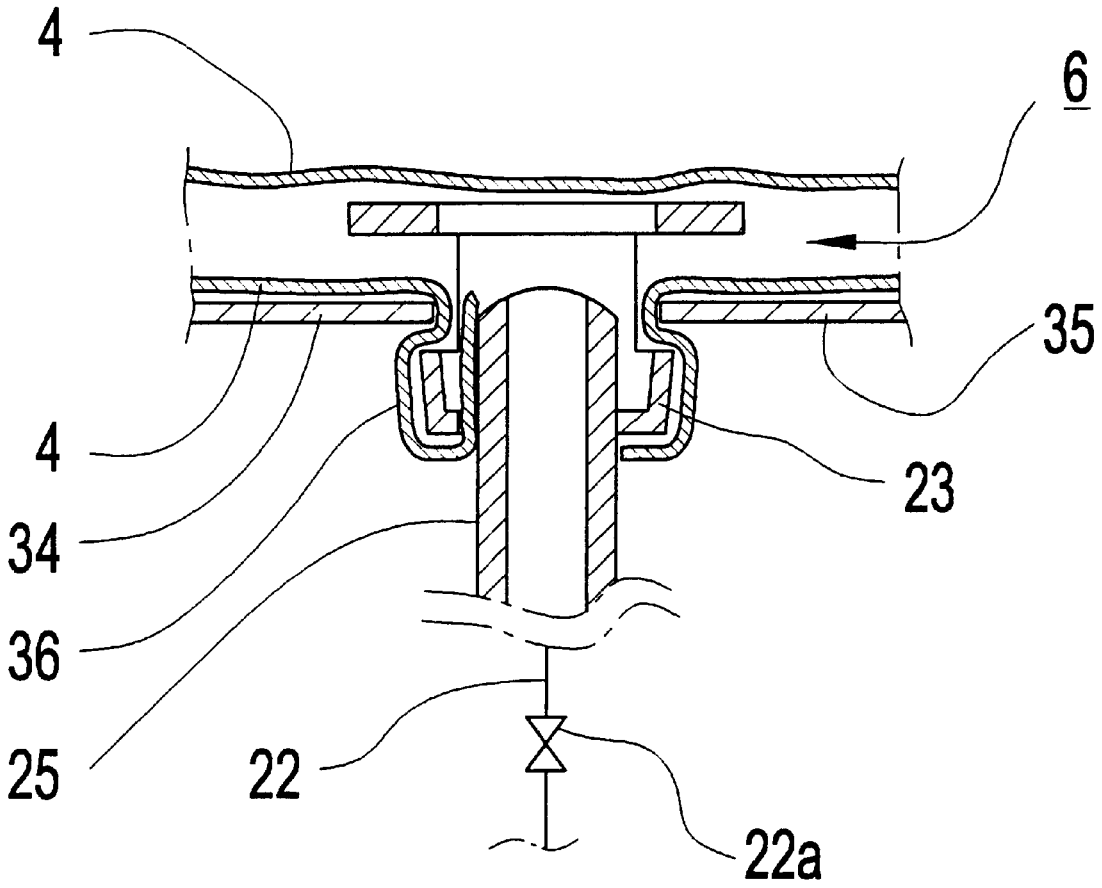
FIG. 10 is a section corresponding to FIGS. 7–9 after emptying of the package and loosening therefrom of a coupling member in the dispensing device.

When the cassette 2 is lowered, the sealed portion 37 of the flexible walls 4 of the package 1 which from the outside covers the opening 24 in the female coupling member 23 of the first coupling device 6, is brought in contact with the male coupling member 25 of the second coupling device 19 of the dispensing device 3 (see FIG. 8). The male coupling member 25 is preferably tubular in shape and has a rounded end surface 38 or such other shape that it first stretches the portion 37 of the flexible walls 4 into the opening 24 of the female coupling member 23 until, through the stretched portion 37, a sealing is obtained between the tubular coupling member 25 and the coupling member 23 of the first coupling device 6 of the package 1. When this sealing has been obtained and the first coupling device 6 of the package 1 by means of the cassette 2 is moved further downwards, the tubular coupling member 25 will tear apart the portions 37 of the flexible walls 4 such that an opening 39 appears (see FIG. 9) through which the tubular coupling member 25 can protrude into the package 1 so that the liquid product 5 can flow out of the package 1 to the valve 21 through said tubular coupling member 25. The opened portion of the flexible walls 4 of the package 1 remains seated on the portion 37 as a flap 37*a*.

The package 1 and its female coupling member 23 are lowered to a dispensing position P by means of the cassette 2 until said female coupling member 23, through remaining portions 37 of the flexible walls 4 outside said coupling member 23 around the male coupling member 25, engages a support means 40 forming part of the dispensing device 3 and preventing the coupling member 25 from penetrating too far into the coupling member 23.

When said coupling members 23, 25 have been brought to this relative connecting position K, they are retained relative to each other with mutual sealing and this connecting position K can he maintained until the package 1 has been emptied, whereupon the cassette 2 can be removed, the emptied package 1 removed from the cassette 2 and replaced by a filled package 1 for sealing of the content therein in the same way as described above.

The male coupling member 25 on the dispensing device 3 can be provided to remain seated at the female coupling member 23 of the package 1 and loosen from the dispensing device 3 when the cassette 2 with more or less emptied package 1 is removed therefrom. There may be a non-return valve 22*a* in the dispensing hose 22 which is automatically closed when the male coupling member 25 is pulled away or released from the dispensing device 3 and which prevents eventual product residuals from flowing out of the package 1.

From the above it is apparent that the cassette 2 is used for storing the package 1 in sealed condition as well as for retaining, with its third coupling device 20, the first coupling device 6 of the package 1 when this is connected to the second coupling device 19 of the dispensing device 3.

Sometimes it can be important to make sure that a package 1 containing a certain liquid product 5 (e.g. medicine) can not be connected to a dispensing device 3 adapted for dispensing portions of another product 5 (e.g. foodstuff). For making this possible, a first coupling device 6 at a first package 1 can be designed and/or provided in another way than a first coupling device 6 at a second package 1, while a second coupling device 19 on a first dispensing device 3 can be designed for connection to a first coupling device 6 on said first package 1 but not to a first coupling device 6 on said second package 1. The first coupling device 6 on said second package 1 can be designed for connection to a second coupling device 19 on a second dispensing device 3, but not to a second coupling device 19 on said first dispensing device 3.

A first coupling device 6 at said first package 1 may e.g. have an opening 24 with a first shape and a first coupling device 6 at said second package 1 may have an opening 24 with another shape.

The second coupling device 19 at said first dispensing device may have a shape which is adapted to the opening 24 in the first coupling device 6 of said first package 1, but not to the opening 24 in the first coupling device 6 of said second package 1, while the second coupling device 19 at said second dispensing device 3 may have a shape which is adapted to the opening 24 in the first coupling device 6 of said second package 1, but not to the opening 24 in the first coupling device 6 of said first package 1.

In combination with said examples or as alternatives thereto, the first coupling device 6 at said first package 1 may take a first position relative to said first package 1 and the first coupling device 6 at said second package 1 a second position relative to said second package 1.

The second coupling device 19 at said first dispensing device 3 may further take a first position which is adapted or adaptable to said first position of the first coupling device 6 in said first package 1, but not to said second position of the first coupling device in said second package 1. Additionally, the second coupling device 19 at said second dispensing device 3 may take a second position which is adapted or adaptable to said second position of the first coupling device 6 in said second package 1, but not to said first position of the first coupling device 6 in said first package 1.

Figure 13:
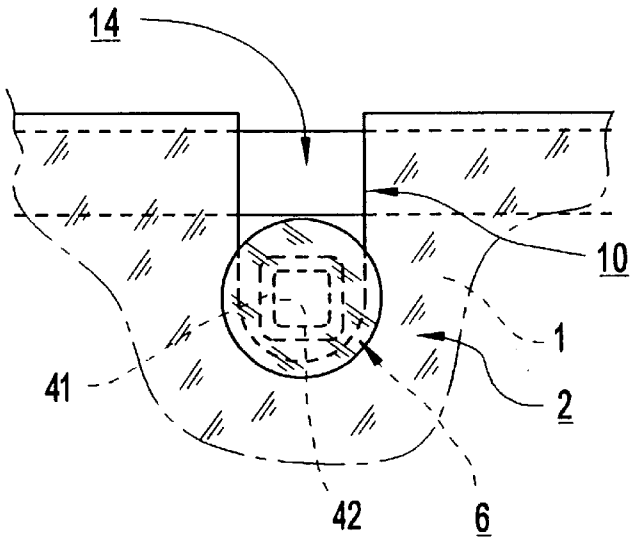
FIG. 13 shows the coupling device of the package in such a position that it can be connected to such a corresponding coupling device which is included in the dispensing device.
Figure 12:
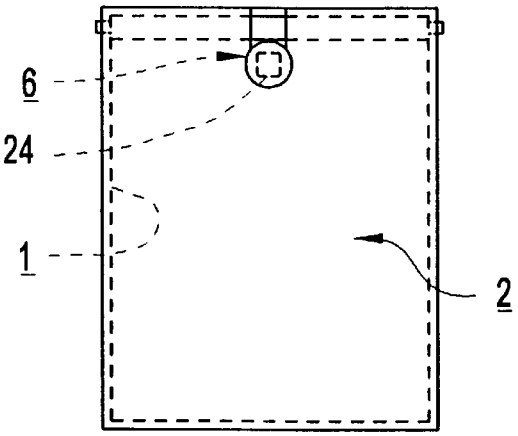
FIG. 12 illustrates the package of FIG. 10 located in the cassette and with the coupling device provided on support members thereof.
Figure 11:
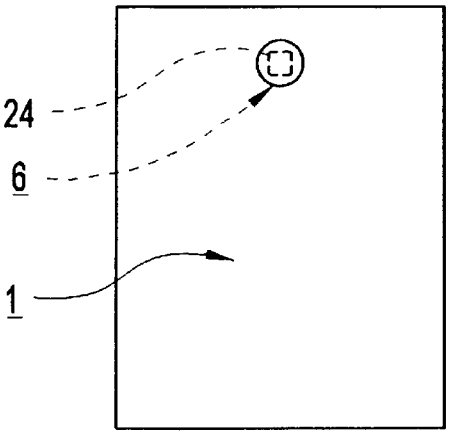
FIG. 11 is a plan view of a package of the type illustrated in FIG. 1 and with an alternative coupling device.

As an example of a design and location of the first coupling device 6 which excludes connection thereof to the wrong dispensing device 3, it can be mentioned that the opening 24 of the first coupling device 6 may be four-sided (see FIGS. 11–13) with the sides 41 directed in a particular manner relative to the package 1.

A second coupling device 19 on said dispensing device 3 may have the same four-sided shape with the sides 42 (see FIG. 13) directed such that the coupling devices 6, 19 can be connected to each other.

Hereby, the first coupling device 6 is attached to the cassette 2 such that it is retained in such a predetermined position that said interconnection is possible.

The first coupling device 6 on packages 1 with another content may have another shape than a four-sided shape, which excludes faulty connection.

The invention described above may vary within the scope of the following claims. As examples of alternatives which are not described in detail nor illustrated in the drawings, it could be mentioned that the coupling devices 6, 19 and 20 can be designed and/or provided in another way than described above. The first coupling device 6 of the package 1 can be located on the outer side of the flexible walls 4 of the package 1 instead of on the inner side thereof or it can be mounted such that parts thereof are located inside and other parts thereof outside the flexible walls 4 of the package 1; the first coupling device 6 of the package 1 can include another number than two opposed parts 32, 33 and these may be located in another way; the cassette 2 can be designed in another way than shown, which e.g. can mean that the support members 34, 35 thereof can be one or more support members provided in another way; one or more support members need not be located on a cassette 2, but can be one or more other members; the liquid product 5 can be another liquid product than foodstuff.

I claim:

1. Dispensing device for dispensing portions of a liquid product, preferably liquid foodstuff, from packages having flexible walls, whereby the package (1) comprises a first coupling device (6), whereby a dispensing device (3) for dispensing portions of the liquid product (5) from the package (1) comprises a second coupling device (19), and whereby the first coupling device (6) of the package (1) and the second coupling device (19) of the dispensing device (3) are interconnectable to open the package (1) and permit dispensing of portions of the liquid product (5) therefrom, charatcterized in that the first coupling device (6) is provided inside a sealed portion (37) of the package (1) and comprises opposed parts (32, 33), that a cassette (2) in which the package (1) can be located comprises a third coupling device (20), that the first coupling device (6) of the package (1) and the third coupling device (20) of the cassette (2) are interconnectable with the sealed portion (37) of the package (1) situated between said first and third coupling devices (6, 20), that the third coupling device (20) of the cassette (2) comprises one or more support members (34 and/or 35), that the support member or support members (34 and/or 35) are provided to fold or bend a flexible wall (4) of the package (1) on opposite sides of the sealed portion (37) inwards within said opposed parts (32, 33) of the first coupling device (6) of the package (1), that the support member or support members (34 and/or 35) are provided to support the first coupling device (6) of the package (1) when it is connected to the third coupling device (20) of the cassette (2), and that the sealed portion (37) of the package (1) can be opened by the second coupling device (19) of the dispensing device (3) when the first coupling device (6) of the package (1) and the third coupling device (20) of the cassette (2) are interconnected and the support member or support members (34 and/or 35) of the third coupling device (20) of the cassette (2) support the first coupling device (6) of the package (1).

2. Dispensing device according to claim 1, characterized in that guide means (19*a*, 19*b*) are provided on the cassette (2) and/or on or at the dispensing device (3) for guiding the cassette (2) when it, with the first coupling device (6) of the package (1) and the third coupling device (20) of the cassette (2) interconnected, is located so that the package (1) takes a dispensing position (P) in which the first coupling device (6) of the package (1) and the second coupling device (19) of the dispensing device (3) are interconnected.

3. Dispensing device according to claim 2, characterized in that said guide means (19*a*, 19*b*) are provided such that they guide the cassette (2) when the package (1) by means thereof is moved to said dispensing position (P).

4. Dispensing device according to claim 2, characterized in that said guide means is at least one hole (19*a*) in the cassette (2) and at least one guide pin (19*b*) on or at the dispensing device (3) and that said guide pin (19*b*) is adapted to engage said hole (19*a*) for guiding the cassette (2).

5. Dispensing device according to claim 1 characterized in that the second coupling device (19) of the dispensing device (3) is provided to open the sealed portion (37) of the package (1) when the first coupling device (6) of the package (1) and the third coupling device (20) of the cassette (2) are interconnected and the first coupling device (6) of the package (1) is connected to the second coupling device (19) of the dispensing device (3).

6. Dispensing device according to claim 1 characterized in that the first coupling device (6) of the package (1) comprises a female coupling member (23) and the second coupling device (19) of the dispensing device (3) a male coupling member (25), that the female and male coupling members (23, 25) are interconnectable and that the sealed portion (37) of the package (1) is provided relative to the female coupling member (23) of the package (1) such that the male coupling member (25) of the dispensing device (3) makes a hole (12) therein when the female and male coupling members (23, 25) are interconnected.

7. Dispensing device according to claim 6, characterized in that the female coupling member (23) has an opening (24) into which the male coupling member (25) is insertable such that said male coupling member (25) is connected to said female coupling member (23).

8. Dispensing device according to claim 1 characterized in that the package (1) is lowerable into the cassette (2) with the flexible walls (4) in a stretched or expanded condition by means of the liquid product (5) present in the package (1), that the flexible walls (4) of the package (1) in said expanded condition engage at least one side (9) of the cassette (2) and that said side (9) of the cassette (2) takes a downwardly inclined position towards the second coupling device (19) on said dispensing device (3) when the first and second coupling devices (6, 19) of the package (1) and dispensing device (3) respectively, are interconnected.

9. Dispensing device according to claim 1, characterized in that the third coupling device (20) of the cassette (2) comprises two support members (34, 35) in the form of edge portions on opposite sides of a recess (10) in the cassette (2) and that the first coupling device (6) of the package (1) is insertable into said recess (10) such that it is connected to said third coupling device (20) of the cassette (2).

10. Dispensing device according to claim 9, characterized in that the first coupling device (6) of the package (1) can be brought down into the recess (10) to a supporting position (S) in which the first coupling device (6) of the package (1) can be locked relative to the cassette (2).

11. Dispensing device according to claim 10, characterized in that the support members (34, 35) in the third coupling device (20) of the cassette (2) intervene or grasp behind opposed parts (32, 33) of the first coupling device (6) of the package (1), that the sealed portion (37) of the flexible walls (4) is situated on the outside of the first coupling device (6) of the package (1) and that the flexible walls (4) on opposite sides of said sealed portion (37) extend as inwardly folded portions (36) in within said opposed parts (32, 33), pass between these parts (32, 33) and said support members (34, 35) and extend into the cassette (2) within said support members (34, 35).

12. Dispensing device according to claim 11, characterized in that the opposed parts (32, 33) are included in an outer annular part and situated on opposite sides of such parts (26, 27) of the first coupling device (6) of the package (1) which extend inwards into the package (1).

13. Dispensing device according to claim 12, characterized in that the inwardly extending parts (26, 27) are connected to an inner annular part (30), whereby the inwardly directed parts (26, 27) and the inner annular part (30) connected thereto together define openings (28, 29) through which the liquid product (5) may flow to an opening (24) through which the liquid product (5) can flow out of the package (1).

14. Dispensing device according to claim 13, characterized in that the width (B) of the inwardly directed parts (26, 27) and the distance (A) between two support members (34, 35) on the cassette (2) on opposite sides of a recess (10) therein for the first coupling device (6) of the package (1) are adapted to each other such that said support members (34, 35) lie in an axial direction within opposed parts (32, 33) of the first coupling device (6) of the package (1).

15. Dispensing device according to claim 9, characterized in that a cover (14) which can be located on the cassette (2) is provided to hold the first coupling device (6) of the package (1) in a supporting position (S) relative to the cassette (2).

16. Dispensing device according to claim 1 characterized in that the package (1) engages a side (9) of the cassette (2) which is designed to define a longitudinal chute (11) which is inclining downwards when the cassette (2) is placed such that the package (1) takes a dispensing position (P) relative to the dispensing device (3).

17. Dispensing device according to claim 1 characterized in that the first and second coupling devices (6, 19) of the package (1) and dispensing device (3) respectively, are provided to define a connection between inner parts of the package (1) and said dispensing device (3), which connection is tight and permits the liquid product (5) to flow out of the package (1) to said dispensing device (3).

18. Dispensing device according to claim 1 characterized in that the first and second coupling devices (6, 19) of the package (1) and dispensing device (3) respectively, are provided to define a tight connection between the interior of the package (1) and of the dispensing device (3) and additionally to define an opening (39) in the flexible walls (4) of the package (1) through which the liquid product (5) can flow out of the package (1).

19. Dispensing device according to claim 18, characterized in that the second coupling device (19) of the dispensing device (3) comprises a male coupling member (25) which is tubular and which has a rounded end surface (38) such that said male coupling member (25), during interconnection of the first and second coupling devices (6, 19) of the package (1) and dispensing device (3) respectively, first stretches or expands a portion (37) of the flexible walls (4) of the package (1) until a sealing is obtained between the male coupling member (25) and the first coupling device (6) of the package (1) through said portion (37) of the flexible walls (4), then tears apart said portion (37) of the flexible walls (4) for defining said opening (39) through which said male coupling member (25) can protrude into the package (1), and finally brings the first coupling device (6) of the package (1) and the second coupling device (19) of the dispensing device (3) to a mutual connecting position (K) in which they are retained or fixed relative to each other with mutual sealing.

20. Dispensing device according to claim 1 characterized in that the first coupling device (6) of the package (1) can be connected to a coupling member (25) forming part of the second coupling device (19) of the dispensing device (3), that said coupling member (25) is provided to loosen from the dispensing device (3) and maintain its connecting position at the first coupling device (6) of the package (1) when said package (1) is removed from the dispensing device (3) and that a nonreturn valve (22*a*) is provided to prevent portions of the liquid product (5) from flowing out of the package (1) when said coupling member (25) has been brought to loosen from the dispensing device.

21. Package having flexible walls and containing a liquid product, preferably liquid foodstuff, which can be dispensed in portions by means of a dispensing device, whereby the package (1) comprises a first coupling device (6), whereby a dispensing device (3) for dispensing portions of the liquid product (5) from the package (1) comprises a second coupling device (19), and whereby the first coupling device (6) of the package (1) and the second coupling device (19) of the dispensing device (3) are interconnectable to open the package (1) and permit dispensing of portions of the liquid product (5) therefrom, characterized in that the first coupling device (6) is provided inside a sealed portion (37) of the package (1) and comprises opposed parts (32, 33), that a cassette (2) in which the package (1) can be located comprises a third coupling device (20), that the first coupling device (6) of the package (1) and the third coupling device (20) of the cassette (2) are interconnectable with the sealed portion (37) of the package (1) situated between said first and third coupling devices (6, 20), that the third coupling device (20) of the cassette (2) comprises one or more support members (34 and/or 35), that the support member or support members (34 and/or 35) are provided to fold or bend a flexible wall (4) of the package (1) on opposite sides of the sealed portion (37) inwards within said opposed parts (32, 33) of the first coupling device (6) of the package (1), that the support member or support members (34 and/or 35) are provided to support the first coupling device (6) of the package (1) when it is connected to the third coupling device (20) of the cassette (2), and that the sealed portion (37) of the package (1) can be opened by the second coupling device (19) of the dispensing device (3) when the first coupling device (6) of the package (1) and the third coupling device (20) of the cassette (2) are interconnected and the support member or support members (34 and/or 35) of the third coupling device (20) of the cassette (2) support the first coupling device (6) of the package (1).

22. Coupling device for packages containing a liquid product, preferably liquid foodstuff, and having flexible walls, whereby the liquid product (5) can be dispensed in portions from the package (1) by means of a dispensing device (3), whereby the package (1) comprises a first coupling device (6) which is located in said package (1), whereby said dispensing device (3) comprises a second coupling device (19), and whereby the first coupling device (6) of the package (1) and the second coupling device (19) of the dispensing device (3) are interconnectable such that the package (1) is opened to permit dispensing of portions of the liquid product (5) therefrom, characterized in that the first coupling device (6) is provided inside a sealed portion (37) of the package (1) and comprises opposed parts (32, 33), that a cassette (2) in which the package (1) can be located comprises a third coupling device (20), that the first coupling device (6) of the package (1) and the third coupling device (20) of the cassette (2) are interconnectable with the sealed portion (37) of the package (1) situated between said first and third coupling devices (6, 20), that the third coupling device (20) of the cassette (2) comprises one or more support members (34 and/or 35), that the support member or support members (34 and/or 35) are provided to fold or bend a flexible wall (4) of the package (1) on opposite sides of the sealed portion (37) inwards within said opposed parts (32, 33) of the first coupling device (6) of the package (1), that the support member or support members (34 and/or 35) are provided to support the first coupling device (6) of the package (1) when it is connected to the third coupling device (20) of the cassette (2), and that the sealed portion (37) of the package (1) can be opened by the second coupling device (19) of the dispensing device (3) when the first coupling device (6) of the package (1) and the third coupling device (20) of the cassette (2) are interconnected and the support member or support members (34 and/or 35) of the third coupling device (20) of the cassette (2) support the first coupling device (6) of the package (1).

23. Coupling device according to claim 22, characterized in that the opposed parts (32, 33) on the first coupling device (6) of the package (1) are provided on inner sides of the coupling member (23) on the first coupling device (6) on opposite sides of parts (26, 27) of the first coupling device (6) of the package (1) which extend from the coupling member (23) in a direction inwards into the package (1), preferably in a direction towards portions of the flexible walls (4) of the package (1) which are opposite to those portions of the flexible walls (4) on which the coupling member (23) of the package (1) is provided.

24. Coupling device according to claim 23, characterized in that the opposed parts (32, 33) on the coupling member (23) on the first coupling device (6) of the package (1) are provided on opposite sides of parts (26, 27) of the first coupling device (6) of the package (1) which extend in a direction inwards into the package (1) and the inner end portions of which are connected to an inner part (30) of the coupling device (6), said inner part (30) being preferably annular.

25. Coupling device according to claim 24, characterized in that the width (B) of the parts (26, 27) directed inwards from the coupling member (23) on the first coupling device (6) of the package (1) and the distance (A) between two support members (34, 35) are adapted to each other such that said support members (34, 35) can retain the first coupling device (6) of the package (1) and that said support members (34, 35) grasp or intervene behind the opposed parts (32, 33) on the first coupling device (6) of the package (1) from opposite sides and are situated outside inwardly folded portions (36) of the flexible walls (4) of the package (1) such that said support members (34, 35) define supports for the first coupling device (6) of the package (1) and retain said first coupling device (6) during and preferably also after interconnection of said first coupling device (6) of the package (1) and the second coupling device (19) of the dispensing device (3).

26. Coupling device according to claim 22 characterized in that the first coupling device (6) of the package (1) can be connected to a coupling member (25) forming part of the second coupling device (19) of the dispensing device (3), that said coupling member (25) is provided to loosen from the dispensing device (3) and maintain its connecting position at the first coupling device (6) of the package (1) when said package (1) is removed from the dispensing device (3) and that a nonreturn valve (22*a*) is provided to prevent portions of the liquid product (5) from flowing out of the package (1) when said coupling member (25) has been brought to loosen from the dispensing device.

27. Coupling device at packages containing a liquid product, preferably liquid foodstuff, and having flexible walls, whereby the liquid product (5) can be dispensed in portions from the package (1) by means of a dispensing device (3), whereby the package (1) comprises a first coupling device (6) which is located therein, whereby said dispensing device (3) comprises a second coupling device (19), and whereby the first coupling device (6) of the package (1) and the second coupling device (19) of the dispensing device (3) are interconnectable such that the package (1) is opened to permit dispensing of portions of the liquid product (5) therefrom, characterized in that the first coupling device (6) of the package (1) comprises opposed parts (32, 33), that portions (36) of the flexible walls (4) of the package (1) can be folded or bent inwards within said opposed parts (32, 33), that one or more support members (34 and/or 35) are located within said opposed parts (32, 33) on the first coupling device (6) of the package (1) through said folded or bent portions (36) of the flexible walls (4) of the package (1) for supporting the first coupling device (6) of the package (1) through said folded or bent portions (36) of the flexible walls (4) of the package (1) when the first coupling device (6) of the package (1) and the second coupling device (19) of the dispensing device (3) are interconnected, that a first coupling device (6) at a first package (1) is designed and/or provided in another way than a first coupling device (6) at a second package (1), and that a second coupling device (19) on a first dispensing device (3) is designed for connection to a first coupling device (6) on said first package (1) but not to a first coupling device (6) on said second package (1) while a first coupling device (6) on said second package (1) is designed for connection to a second coupling device (19) on said second dispensing device (3), but not to a second coupling device (19) on said first dispensing device (3).

28. Coupling device according to claim 27, characterized in that a first coupling device (6) at said first package (1) has an opening (24) with a first shape and a first coupling device (6) at said second package (1) has an opening (24) with another shape, that a second coupling device (19) at said first dispensing device (3) has a shape which is adapted to the opening (24) in the first coupling device (6) of said first package (1), but not to the opening (24) in the first coupling device (6) of said second package (1), and that a second coupling device (19) at said second dispensing device (3) has a shape which is adapted to the opening (24) in the first coupling device (6) of said second package (1), but not to the opening (24) in the first coupling device (6) of said first package (1).

29. Coupling device according to claim 27, characterized in that a first coupling device (6) at said first package (1) takes a first position relative to said first package (1) and a first coupling device (6) at said second package (1) a second position relative to said second package (1), that a second coupling device (19) at said first dispensing device (3) takes a first position wihch is adapted or adaptable to said first position of a first coupling device (6) in said first package (1), but not to said second position of a first coupling device (6) in said second package (1), and that a second coupling device (19) at said second dispensing device (3) takes a second position which is adapted or adaptable to said second position of a first coupling device (6) in said second package (1), but not to said first position of a first coupling device (6) in said first package (1).

* * * * *